United States Patent [19]

Fohrman et al.

[11] Patent Number: 4,635,366

[45] Date of Patent: Jan. 13, 1987

[54] POLYMERIC SHOE SIZER

[76] Inventors: Scott R. Fohrman, 1123 Linden, Wilmette, Ill. 60091; Herbert Steinmetz, Rte. 2, Box 340, Elk Mound, Wis. 54739

[21] Appl. No.: 809,316

[22] Filed: Dec. 16, 1985

[51] Int. Cl.[4] ..... A43D 1/00

[52] U.S. Cl. ..... 33/3 B; 33/3 R

[58] Field of Search ..... 33/3 R, 3 B, 3 A, 3 C

[56] References Cited

U.S. PATENT DOCUMENTS

| | | | |
|---|---|---|---|
| 770,065 | 9/1904 | Hertzler et al. | 33/3 C |
| 1,568,072 | 1/1926 | Krueger et al. | 33/3 B |
| 1,837,809 | 12/1931 | Delhaye | 33/3 C |
| 2,507,032 | 5/1950 | Mantos | 33/3 B |
| 2,522,899 | 9/1950 | Schlaugh et al. | 33/3 B |

*Primary Examiner*—Willis Little

*Attorney, Agent, or Firm*—Lawrence J. Crain

[57] ABSTRACT

A shoe sizer capable of measuring the feet of men or women and designed to be readily shipped by mail, comprising a base having a flat upper surface, an elongate slot, and a plurality of mounting recesses; a vertically-projecting heel portion having a mounting lug for engaging one of the mounting recesses and designed to accurately and consistently position a heel on a selected portion of said base; a vertically projecting stopping member to aid in the proper positioning of the foot; a foot width indicator which is slidably engaged in the elongate slot; and a sizing grid placed on the upper surface of the base so as to accurately and consistently measure the size and width of either men's or women's feet.

10 Claims, 6 Drawing Figures

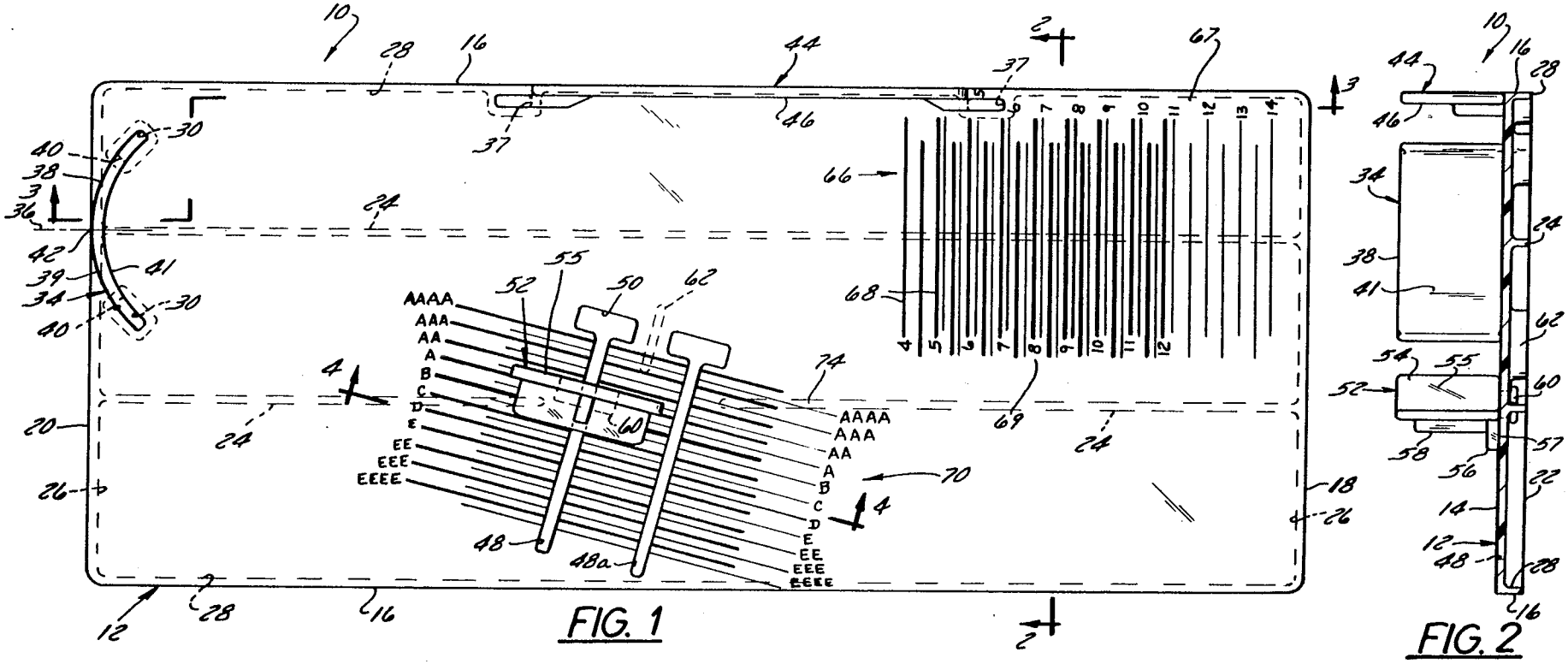
FIG. 1
FIG. 2
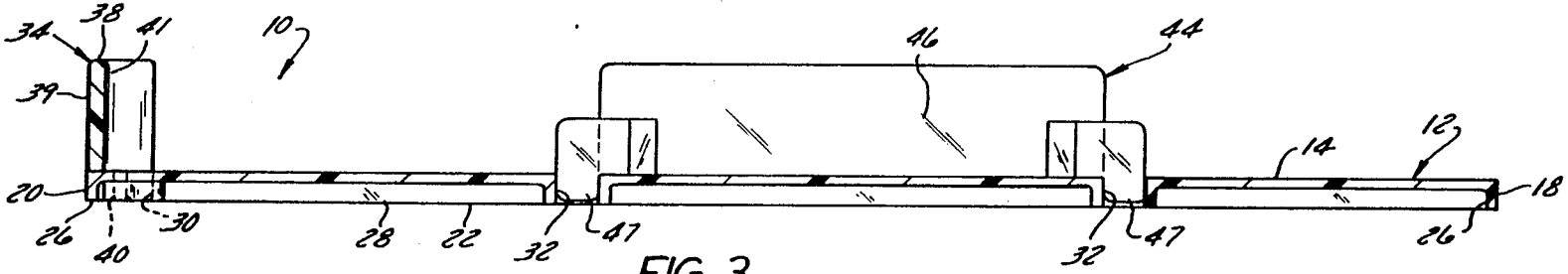
FIG. 3

POLYMERIC SHOE SIZER

BACKGROUND OF THE INVENTION

The present invention relates to shoe sizers, and more specifically to shoe sizers designed to use by male and female customers of mail order shoe distributors or self service shoe stores.

The ability to order shoes by mail is a widely accepted practice, and an especially convenient one for customers living in remote or rural areas. A problem inherent with this type of marketing is the difficulty in accurately determining the correct shoe size. An added wrinkle to this problem is that different mail order manufacturers produce shoes having size designations which are not interchangeable. Thus it is critical for a customer to be able to accurately determine his size according to the manufacturing pattern of a particular manufacturer.

If the customer is unable to properly determine his shoe size, he will order poorly fitting shoes and will become dissatisfied with the distributor. The shoes will then either go unused, the distributor having lost a customer, or the shoes will be returned to the distributor, often with shipping costs borne by the distributor. Even if the customer is willing to try another pair, there is a high probability of another incorrect selection.

Thus, it is desirable for mail order shoe distributors to be able to provide a low cost, accurate shoe sizer either alone or shipped with a pair of shoes.

Conventional shoe sizers are represented by a common model produced by the Brannock Company of Syracuse, N.Y., and found in most conventional shoe stores. The Brannock device comprises a metallic base plate having vertically projecting heel plates at either end, and a pair of sliding width gauges, one to measure the width of a foot placed in each of the heel plates. The Brannock device is unsuitable for use by mail order distributors because its metal construction and relatively large size make it cumbersome and overly expensive to ship by mail. Also, the Brannock device costs too much to manufacture for the limited amount use to which it would be put by mail order customers, or the abuse and potential for theft in self service shoe stores. Furthermore, a separate Brannock device is required for men's and women's sizes. Lastly, the accuracy of the Brannock device is questionable.

Attempts to make shoe sizers lighter and less expensive normally involve the use of polymeric materials. One previously encountered drawback of polymeric shoe sizers is the inability to accurately imprint a shoe sizing grid upon a plastic surface without encountering obstructions caused by molded, projecting members serving as heel plates or other foot positioning means. Another drawback of conventional polymeric shoe sizers manufactured by conventional molding methods is the presence of integral, vertically-projecting members which create a device too bulky to conveniently ship by mail. Still another drawback of conventional polymeric shoe sizers is the requirement for separate men's and women's models.

Thus, a major objective of the present invention is to provide a low cost shoe sizer which can be readily shipped by mail in a flat package.

It is another object of the present invention to provide shoe sizer which is more accurate than present devices.

It is a further object of the present invention to provide a shoe sizer which can be used by both men and women.

SUMMARY OF THE INVENTION

A shoe sizer is provided which can be easily used by both men and women, is lightweight, inexpensive to produce, and is more accurate than previous models.

More specifically, the present invention comprises a flat polymeric base portion having a plurality of mounting recesses, at least one elongate width indicator slot, and sizing grids which are used to accurately determine the size and width of both men's and women's feet.

A specially designed heel cup is provided which, when inserted in the appropriate mounting recesses, consistently places the foot to be measured in the same location for optimum accuracy. A stopping member is also provided which extends vertically from the base surface to aid in proper foot positioning. The stopping member is also inserted into special recesses in the base. A foot width indicator is inserted into the base to tightly yet slidably engage the corresponding foot width indicator slot.

The components of the present invention are easily assembled by the average customer and, once assembled, the present invention provides an easy to use, and consistently accurate indication of shoe size.

DESCRIPTION OF THE DRAWINGS

The novel features and advantages of the present invention will become more apparent upon a review of the drawings, in which FIG. 1 illustrates a plan view of a shoe sizer of the present invention;

FIG. 2 illustrates an end view of the base of the present invention;

FIG. 3 depicts a side view of the assembled shoe sizer of FIG. 1;

DESCRIPTION OF THE PREFERRED EMBODIMENT

Figure 6:
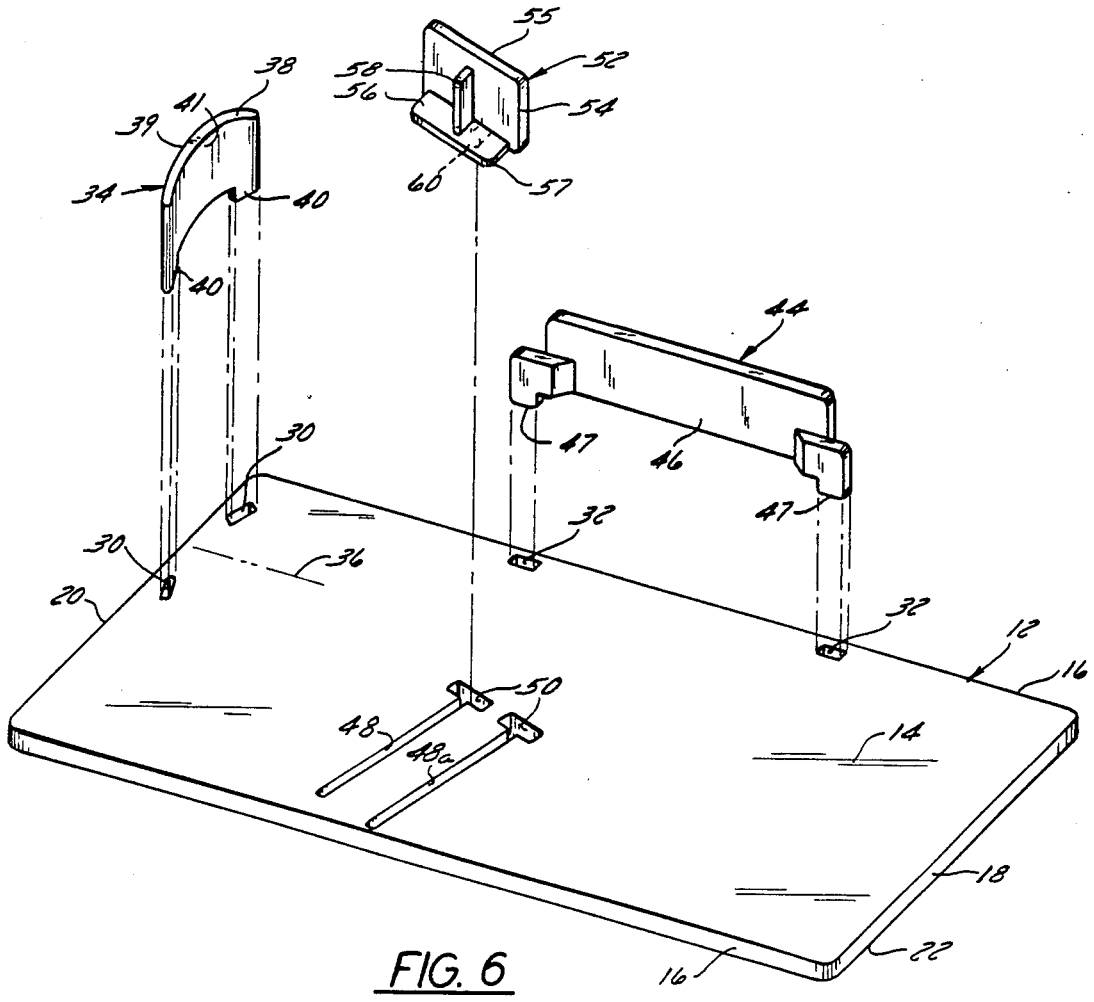
FIG. 6 depicts an exploded perspective view of the indicator shown in FIG. 1.

Referring now to the drawings; wherein like reference numerals indicate like elements, a shoe sizer 10 is depicted comprised of a base 12 having a flat upper surface 14, a pair of sides 16, a toe end 18, a heel end 20, and an underside 22. The underside 22 is provided with a plurality of longitudinal support ribs 24, which are integrally joined to underside 22 and extend the length of base 12. At least one of support ribs 24 is positioned so that stress placed on base 12 by a foot placed on upper surface 14 will be minimized. Aside from providing a support function, ribs 24 serve to elevate the base 12 for reasons described in greater detail below.

Base 12 is further provided with lateral support ribs 26 located at the margin of both heel end 20 and toe end 18. Support ribs 26 are integrally joined to peripheral support ribs 28 to form an integral peripheral support for base 12.

Upper surface 14 is also provided with at least two heel cup mounting recesses 30 located at the heel end 20 and at least two ball stop mounting recesses 32 located adjacent to one of the sides 16.

A crescently curved heel cup 34 is designed to center feet of varying sizes along a measurement axis 36 to achieve maximum accuracy. Heel cup 34 is comprised of a curved, vertically projecting portion 38 and at least two vertically depending mounting lugs 40. Curved portion 38 is further comprised of a convex portion 39 and a concave portion 41. Heel cup 34 is inserted into base 12 so that concave portion 41 faces toe end 18. The apex 42 of curved portion 38 is preferably situated above the intersection of lateral rib 26 with a longitudinal support rib 24 for maximum strength.

The curvature of curved portion 38 is determined by a statistical sampling of customer's feet to more accurately position feet of varying dimensions to be centrally located above axis 36.

Mounting lugs 40 are designed to tightly engage mounting recesses 30 so that heel cup 34 is securely mounted in base 12 without the need for chemical adhesives or other fasteners. Although mounting lugs 40 and mounting recesses 30 may be provided in any number of shapes, the preferred embodiment is provided with mounting lugs having a rectangular configuration.

Ball stop 44 is comprised of an elongate, vertically projecting, laterally flattened portion 46 and at least two vertically depending mounting lugs 47 integrally joined thereon. Laterally flattened portion 46 is preferably rectangular in shape, but may be fabricated to have any one of a variety of shapes, provided that enough lateral surface area is included to engage the balls of a variety of men's and women's feet. Satisfactory results have been obtained with a ball stop having a length on the order of 4 to 5 inches.

Mounting lugs 47 are integrally joined to portion 46 and are provided with a configuration similar to heel cup mounting lugs 40 described above. Lugs 47 are designed to tightly engage ball stop mounting recesses 32 without the use of chemical adhesives or fasteners. In some cases, both heel cup 34 and/or ball stop 44 may be designed to releasably engage base 12 for subsequent breakdown for reshipping.

Base 12 is further provided with at least one elongate foot width indicator slot 48 oriented at an angle to the measurement axis 36. The most accurate foot width measurements have been obtained when the angle of the elongate slot 48 to the measurement axis is on the order of 75° to 85°.

The end of slot 48 which is closest to measurement axis 36 is provided with an access aperture 50 which is designed to allow foot width indicator 52 a means to be placed in sliding engagement with slot 48. In the preferred embodiment, a second slot **48*a*** is provided to accomodate a wider range of variations in foot width.

Figure 5:
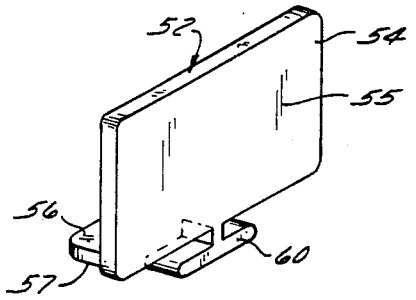
FIG. 5 depicts a perspective view of the indicator shown in FIG. 4.
Figure 4:
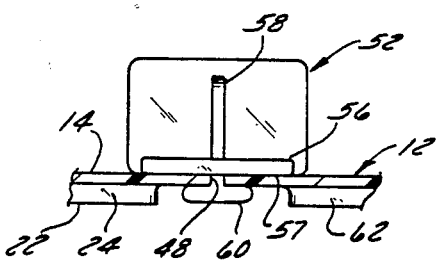
FIG. 4 illustrates an end view of the foot width indicator of the present device.

Referring now to FIGS. 4–6, a foot width indicator 52 is pictured, comprising a vertically extending foot engaging portion 54, a rearwardly projecting basal support member 56, a vertical support rib 58 and a vertically depending, inverted 'T' shaped tracking guide 60.

Foot engaging portion 54 is designed to have a flat face 55 which will engage the widest part of the foot. Face 55 will be long enough on either side of the measured foot to register on the foot width sizing grid described below.

Basal support member 56 is integrally joined to vertically projecting portion 54 to form an L-shape in cross section. The underside 57 of support member 56 slides along the upper surface 14 of base 12 and provides support so that front to rear stability of vertically projecting portion 54 is minimized.

Vertical rib 58 is integrally joined to vertically projecting portion 54 and basal support member 56 to strengthen those two components.

Foot width indicator 52 is inserted into slot 48 or **48*a* by placing T-shaped tracking guide 60 into aperture 50 so that face 55 is pointed at ball stop 44. Foot width indicator 52 is then slid into slot 48 or 48*a* so that tracking guide 60 engages the edges 15 of base 12 which comprise slots 48 and 48*a*. Tracking guide 60 is constructed and arranged to tightly yet slidably engage slots 48 and 48*a*** to ensure accurate foot width measurement for both men's and women's feet.

Longitudinal, peripheral and lateral support ribs 24, 28 and 26 respectively, must be provided with adequate height to elevate upper surface 14 high enough from the floor upon which the device 10 is placed to allow sufficient clearance for the sliding action of tracking guide 60 in slots 48 and **48*a***.

Referring now to surface 14, a sizing grid 66 is located at toe end 18. Sizing grid 66 is comprised of a plurality of parallel lines 68 oriented perpendicularly to axis 36. Numerals indicating men's sizes 67 are located on one side of the lines 68, and women's sizes 69 are located on the opposite side. For convenient sizing, the lines and numerals representing men's sizes may be printed in a different color than those representing women's. Also, lines 68 may be staggered to make them more distinguishable.

Foot width grid 70 is located on upper surface 14 adjacent to and on either side of slots 48 and **48*a*. As was the case with sizing grid 66, foot width grid 70 comprises a plurality of parallel lines 72 and a sequence of width designations, 74 usually alphabetical letters. In similar fashion to grid 66, width grid 70 may differentiate the men's from women's widths by means of a line and/or width designation color. In the preferred embodiment, the men's width grid is located one one side of slots 48 and 48*a*, and the women's is located on the opposite side. Although grid lines 72 for men's and women's widths generally correspond to each other on either side of slots 48 and 48*a***, the men's or women's grids may be positioned at an angle to the lines of the other sex.

A customary method of applying the sizing grid 66 and width grid 70 is by silk screen printing. A major advantage of the present invention over conventional polymeric shoe sizers is that the sizing grids 66 and 70 may be easily and accurately applied to the upper surface 14 of base 12 before the installation of heel cup 34 and ball stop 44.

Base 12, heel cup 34, ball stop 44 and foot width indicator 52 are preferably fabricated of a polymeric material using conventional molding technology. Polymers having the following characteristics are preferred: the ability to accept silk screening, dimensional stability, high fatigue strength, a high flexural modulus, internal rigidity, and low dermal toxicity. High impact polystyrene or similar materials are acceptable.

In operation, a foot to be measured, preferably the right foot, is placed in heel cup 34 so the foot is centered over axis 36. The ball of the foot is placed against the ball stop 44. Depending upon the sex of the individual whose foot is being measured, the sizing line 68 closest to the leading edge of the toes will indicate the shoe size. Next, foot width indicator 52 is slid along slot 48 until it contacts the outer edge of the measured foot. The outer edges of vertical member 54 will indicate the proper width on grid 70.

Thus, the present invention provides a low cost, polymeric, shoe sizer which is comprised of a flat base upon which is accurately affixed shoe sizing and width grids. The shoe sizer of the present invention is designed to allow for accurate placement of the sizing grids on the base. The present invention is also designed to have a flattened construction to facilitate its use by mail order shoe distributors.

Although various embodiments of the present shoe sizer have been shown and discussed, it will become obvious to those skilled in the art that departures can be made with regard to various components without departing from the spirit and scope of the claims.

What is claimed is:

1. An apparatus for measuring the length and width of the feet of adult men and women, each of said feet having a length, a width, a ball, and an outside edge, in order to determine proper shoe size comprising:

a unitary polymeric base comprising a flat horizontal surface, a length, a width, an underside, at least one elongate slot and plurality of support ribs integrally joined to said underside;

means for positioning the heel of the foot to be measured in one location on said base, comprising a vertically-projecting curved member having vertically depending mounting lugs;

stopping means for positioning the ball of the foot to be measured comprising a vertically-projecting stop wall having vertically depending mounting lugs;

mounting means for securing said heel positioning means and said stopping means to said base comprising a plurality of accurately positioned recesses in said horizontal surface of said base and designed to positively, frictionally engage said mounting lugs of said heel positioning and stopping means;

one piece foot width determining means securely, yet slidably mounted into said slot in said base;

men's and women's sizing grids designed to be accurately affixed upon said base to measure a foot of either sex placed in the same location on said base; and wherein said apparatus is designed to be inexpensively shipped by mail and assembled by an inexperienced purchaser without the use of tools.

2. The apparatus defined in claim 1 wherein said elongate slot is oriented at an angle to the length of said base.

3. The apparatus defined in claim 1 wherein said foot width indicator comprises a vertically projecting curved portion, an inverted T-member having a stem portion depending vertically from said curved portion, and two laterally projecting arms.

4. The apparatus defined in claim 3 wherein said foot width indicator engages said slot so that limited vertical movement is possible.

5. The apparatus defined in claim 4 wherein said arms of said inverted T-member are designed to restrain the vertical movement of said foot width indicator in said slot.

6. The apparatus defined in claim 1 wherein said curved heel positioning means is constructed and arranged to accurately and consistently position foot of either a man or a woman to be measured in a specific location on said base.

7. A polymeric shoe sizer for measuring the feet of men and women, designed to be readily shipped by mail and assembled without the use of tools, said shoe sizer comprising:

a base having a length and width, a flat upper surface, an elongate slot having two sides, a plurality of mounting recesses and means to elevate said upper surface, a designated minimum distance above a floor surface to accommodate a slidable foot width indicator;

a vertically projecting heel positioning member having a curved configuration which accurately and consistently positions feed of either men or women in the same location on said flat upper surface;

a vertically projecting stopping member for accurately positioning the ball of the foot;

a plurality of vertically depending mounting lugs integrally joined to said heel positioning member and said stopping member for releasably, yet positively engaging said members with said mounting recesses in the upper surface of said base;

a foot width indicator designed to slidably engage said elongate slot; and a sizing grid designed to be placed on said upper surface and which is capable of measuring the size and width of either a man's or a woman's foot which has been properly positioned by said heel positioning member, said foot stopping member and said foot width indicator.

8. The apparatus defined in claim 7 wherein said elongate slot is oriented at an angle to the length of said base.

9. The apparatus defined in claim 8 wherein said elongate slot is provided with a vertically depending rib adjacent to each side, said ribs forming a track.

10. The apparatus defined in claim 9 wherein said foot width indicator is comprised of a vertically projecting portion which engages said foot, and a depending slot engaging portion positioned below said vertically projecting portion and constructed and arranged to tightly, slidingly engage said slot and said track.

* * * * *